US010450859B2

(12) United States Patent
Liu et al.

(10) Patent No.: US 10,450,859 B2
(45) Date of Patent: Oct. 22, 2019

(54) MUD PULSER WITH VERTICAL ROTATIONAL ACTUATOR

(71) Applicant: Bitswave Inc., Sugar Land, TX (US)

(72) Inventors: Ce Liu, Sugar Land, TX (US); James Morehead, Sugar Land, TX (US)

(73) Assignee: Bitswave Inc., Sugar Land ( * ) Notice: Subject to any disclaimer, the term of this patent is extended or adjusted under 35 U.S.C. 154(b) by 570 days.

(21) Appl. No.: 14/926,229

(22) Filed: Oct. 29, 2015

(65) Prior Publication Data

US 2017/0058667 A1 Mar. 2, 2017

Related U.S. Application Data

(60) Provisional application No. 62/209,173, filed on Aug. 24, 2015.

(51) Int. Cl.
*E21B 47/18* (2012.01)

(52) U.S. Cl.
CPC ..... *E21B 47/187* (2013.01)

(58) Field of Classification Search
CPC ..... E21B 47/187
USPC ..... 367/83–84
See application file for complete search history.

(56) References Cited

U.S. PATENT DOCUMENTS

| | | | | |
|---|---|---|---|---|
| 3,538,741 | A * | 11/1970 | Ludwin | G01F 15/005 73/1.27 |
| 4,712,613 | A | 12/1987 | Nieuwstad | |
| 5,215,152 | A | 6/1993 | Duckworth | |
| 6,173,772 | B1 | 1/2001 | Vaynshteyn | |
| 7,397,388 | B2 | 7/2008 | Huang | |
| 2009/0067288 | A1 | 3/2009 | Godager | |
| 2010/0108390 | A1 | 5/2010 | Teodorescu | |
| 2010/0157735 | A1* | 6/2010 | Allan | E21B 47/187 367/84 |
| 2011/0297380 | A1 | 12/2011 | Alberty | |
| 2014/0160891 | A1 | 6/2014 | Russell | |

* cited by examiner

*Primary Examiner* — Nay Tun
(74) *Attorney, Agent, or Firm* — Bracewell LLP; Constance G. Rhebergen

(57) ABSTRACT

A mud pulser system for use in a wellbore includes a pulser assembly disposed in a drill string and through which drilling fluid is metered in order to generate pressure pulses in the drilling fluid. The pulser assembly includes a pulser body having an inlet and an exit. Included in the pulser body is a rotary member having multiple ports formed through the member. The rotary member can be spherically shaped. The ports are formed so that selectively rotating the rotary member registers opposing ends of a one of the ports with the inlet and exit in the body to provide communication between the inlet and exit. An actuator couples with the rotary member for its selective rotation.

18 Claims, 4 Drawing Sheets

MUD PULSER WITH VERTICAL ROTATIONAL ACTUATOR

CROSS REFERENCE TO RELATED APPLICATIONS

This application is a continuation of, and claims priority to and the benefit of, U.S. Provisional Application Ser. No. 62/209,173, filed Aug. 24, 2015, the full disclosure of which is hereby incorporated by reference herein in its entirety and for all purposes.

BACKGROUND OF THE INVENTION

1. Field of Invention

The present disclosure relates to a system for creating pulses in wellbore fluid. More specifically, the present disclosure relates to a downhole telemetry system with a multi-ported valve.

2. Description of Prior Art

Information about a hydrocarbon producing formation are often obtained during operations conducted a borehole that intersects the formation. Typical wellbore operations that also involve gathering downhole information include measuring while drilling (MWD) and logging while drilling (LWD). The formation information generally includes downhole fluid pressure and/or temperature, and information about the formation, such as its resistivity, density, tool orientation and position, and porosity. The information obtained during MWD and LWD is usually communicated to surface via mud pulse telemetry in real time, where fluid flowing through a downhole string is intermittently metered in order to create pressure pulses in the fluid. During mud pulse telemetry, metering the fluid is done sequentially to generate discernible signals, represented by pressure variations in the fluid, that are thee carried by the fluid back to surface. The sensors on the surface (e.g., pressure sensors) will convert the pressure change in the mud system to electrical signals for further processing.

Some currently known mud pulsers use plungers or disk actuators for creating pressure pulses. The plunger type actuators blocks and released mud flow by a piston in the mud channel, and can be oriented vertically or horizontally. Disk actuators are made up of horizontally disposed disks that have axial openings. Rotating or oscillating the disks with respect to one another selectively moves the openings in and out of registration to intermittently block and allow flow across the disks, thereby introducing pressure pulses into the drilling fluid. A drawback to the use of plungers for creating mud pulses is the force required to move the plunger in and out of the way of its associated opening. The large force required to move the plungers limits the speed at which the plungers can operate, thereby limiting the data density that can be relayed uphole. Similarly, large shear forces between the rotating disks resists their respective rotational speed.

SUMMARY OF THE INVENTION

Disclosed herein are examples of a mud pulser system for use with a drilling system and methods of generating mud pulses in drilling fluid in a wellbore. One example of a mud pulsar system for use with a drilling system includes a pulser assembly disposed in a path of drilling fluid flowing through the drill string. The pulser assembly is made up of a body with an inlet, an exit, and a cavity between the inlet and exit. A rotary member is disposed in the cavity, and multiple ports formed through the rotary member. In this example, when the rotary member is selectively rotated to register an end of one of the ports with the inlet, an opposing end of the one of the ports registers with the exit, so that the drilling fluid flows between the inlet and exit and through the one of the ports; and so that when the rotary member is selectively rotated to move all of the ports out of registration with the inlet, a pressure pulse is generated in the drilling fluid. In one example the rotary member is selectively oscillated to move the one of the ports into and out of registration with the inlet. The rotary member can be axially moveable within the cavity. In an alternative, the rotary member is selectively rotatable for modulation of frequency, phase, or amplitude of the pressure pulse generated in the drilling fluid. A controller for controlling rotation of the rotary member can be included with the mud pulser system. Embodiments exist where the inlet has a square, rectangular, circular, or oval shape. The rotary member can be spherical, ovoid, or cylindrical. An actuator can further be included that is coupled to the rotary member. In one example, the ports intersect with one another proximate a mid-portion of the rotary member. The rotary member can be selectively moveable between first and second positions within the purser assembly. An elevator assembly can be included, that when selectively activated biases the rotary member into a one of the first or second positions.

Also disclosed herein is a method of generating mud pulses in a wellbore, and which includes providing a mud pulser system having a pulse assembly that is made up of a body, an upper passage in the body, a cavity in the body intersected by the upper passage, a lower passage in the body that intersects a portion of the cavity distal from the upper passage, and a rotatable member in the cavity having an outer surface and multiple ports that each have distal ends intersecting the outer surface at substantially diametrically opposed locations. The method further includes disposing the mud pulser system in a wellbore, providing a supply of drilling fluid to an end of the upper passage distal from the cavity, and generating pulses in the drilling fluid by rotating the rotatable member so that the ports selectively move into registration with both the upper and lower passages thereby providing fluid communication through the pulser assembly for discrete periods of time. A single rotation of the rotatable member can generate four pulses in the drilling fluid. The method can further include removing debris accumulated within the axially moving the rotatable member within the cavity, as well as optionally modulating one or more of a frequency, phase, or amplitude of the generated pulses. The poises, can represent data, so that by monitoring the pulses in the drilling fluid, the data represented by the pulses is identified.

A drilling system is disclosed herein that includes a drill string having an annulus in communication with a supply of drilling fluid, a bottom hole assembly mounted to an end of the drill string, a flow path in the bottom hole assembly in communication with the annulus in the drill string, so that when drilling fluid is directed through the drill string, the drilling fluid flows into the flow path. This example of the drilling system also includes a pulser assembly disposed in the flow path, and that is made up of a body with an inlet, an exit, and a cavity between the inlet and exit, a rotary member disposed in the cavity, and multiple ports formed through the rotary member. In an embodiment, selectively rotating the rotary member registers an end of one of the ports with the inlet and registers an opposing end of the one of the ports with the exit, so that the drilling fluid flows between the inlet and exit and through the one of the ports, and so that when the rotary member is selectively rotated to move all of the ports out of registration with the inlet, a pressure pulse is generated in the drilling fluid. In one example, rotating the rotary member while drilling fluid is flowing through the pulser assembly generates a pressure pulse in the drilling fluid, and wherein the pressure pulse is monitored. The drilling system may optionally further include a processor for controlling rotation of the rotary member, so that the rotation of the rotary member is controlled to generate pressure pulses in the drilling fluid, and wherein data is encoded in the pressure pulses that can be decoded at a location distal from the rotary member.

BRIEF DESCRIPTION OF DRAWINGS

Some of the features and benefits of the present invention having been stated, others will become apparent as the description proceeds when taken in conjunction with the accompanying drawings, in which.

Figure 1:
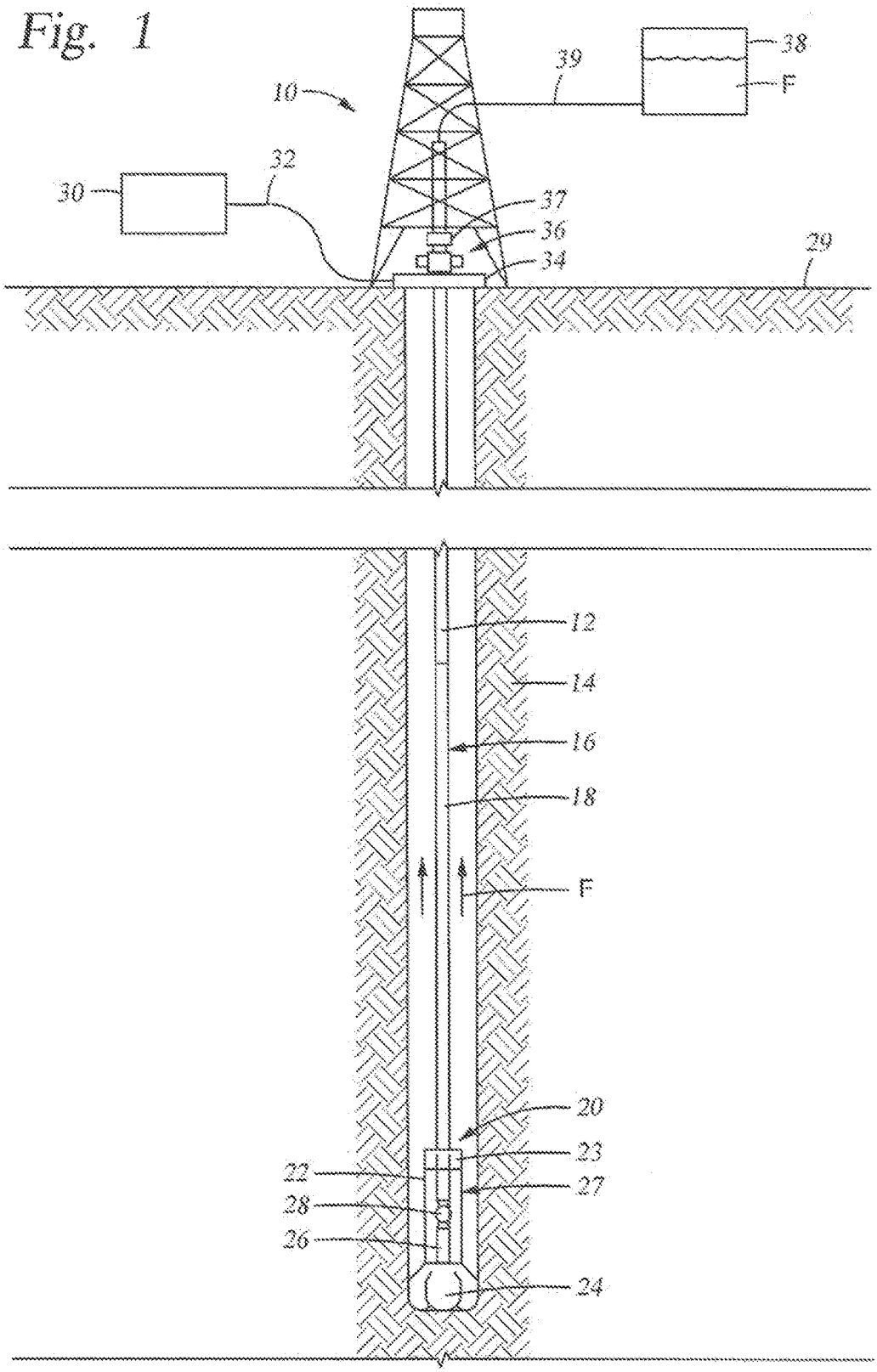
FIG. 1 is a side sectional view of an example of a drilling system forming a wellbore, and which includes a mud pulse telemetry system.

While the invention will be described in connection with the preferred embodiments, it will be understood that it is not intended to limit the invention to that embodiment. On the contrary, it is intended to cover all alternatives, modifications, said equivalents, as may be included within the spirit and scope of the invention as defined by the appended claims.

DETAILED DESCRIPTION OF INVENTION

The method and system of the present disclosure will now be described, more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Illustrated in side sectional view in FIG. 1 is one example of a drilling system 10 shown forming a borehole 12 through a formation 14. The drilling system 10 includes a drill string 16 made up of individual lengths of drill pipe 18 threaded together. The lower end of the drill string 16 is equipped with a bottom hole assembly ("BHA") 20, where the BBA 20 includes a drill collar 22. A downhole sensor 23 is shown provided with the drill collar 22, and which can sense conditions downhole as well as parameters of the formation 14. Examples of the values being sensed include one or mom of pressure, temperature, resistivity, inductance, porosity, direction, orientation, and combinations thereof. A drill bit 24 is depleted on a lower end of the drill collar 22, that when rotated excavates away amounts of the formation 14 to form the borehole 12. A flow path 26 is shown in dashed outline extending axially through the BHA 20, and through which the inner surface of the drilling pipe 18 and drill bit 24 are in fluid communication. Thus drilling fluid F injected into the drilling string 18 enters the drill bit 24 after passing through the flow path 26 in the drill collar 22. The drilling fluid F is ejected from the drill bit 24 through nozzles (not shown), and flows back up the borehole 12, cuttings removed from the formation 14 by the drill bit 24 can be carried uphole with the returning drilling fluid F.

A mud pulser system 27 is shown schematically disposed in the BHA 20 and in the flow path 26 of the BHA 20. The mud pulser system 27 includes a pulser assembly 28 that is selectively actuated to vary a pressure drop of drilling fluid flowing across the pulser assembly 28, and thereby generate pulses of pressure in the drilling fluid. In an embodiment, pressure pulses are strategically generated in the drilling fluid which represent data acquired by the sensor 23. The data, represented by the pressure pulses, can be communicated via the drilling fluid flowing uphole, and where the pulses can be detected and/or decoded at surface 29. More specifically, a controller 30 is shown that via a communication means 32, detects and/or records the pressure pulses at a wellhead 34 provided proximate an opening of the wellborn 12. Controller 30 can include a demodulator (not shown) equipped for phase demodulation, amplitude demodulation, and/or frequency demodulation for demodulating the pressure pulses monitored in the wellhead 34. In an example, information extracted from the pressure pulses is recorded by controller 30, directed by controller 30 to a site remote from the borehole 12 for analysis, or recorded by controller 30 and then conveyed to the remote site for analysis. Communication means 32 can be hard wired or wireless, and the controller 30 can be proximate to or remote from the website. In the illustrated example a blowout preventer 36 is shown mounted on wellhead 34. Optionally, a rotary table 37 is shown that is used for rotating the drill pipe 18 (and thus drill string 16). Alternatively, a top drive (not shown) can be used for rotating the drill pipe 18 instead of the rotary table 37. Further in the example of FIG. 1 is a reservoir 38 for supplying drilling fluid P to the drill string 16. More specifically, a line 39 directs drilling fluid F from reservoir 38 to the drilling system 10 for delivery downhole via an annulus in the drill pipe 18.

Figure 2:
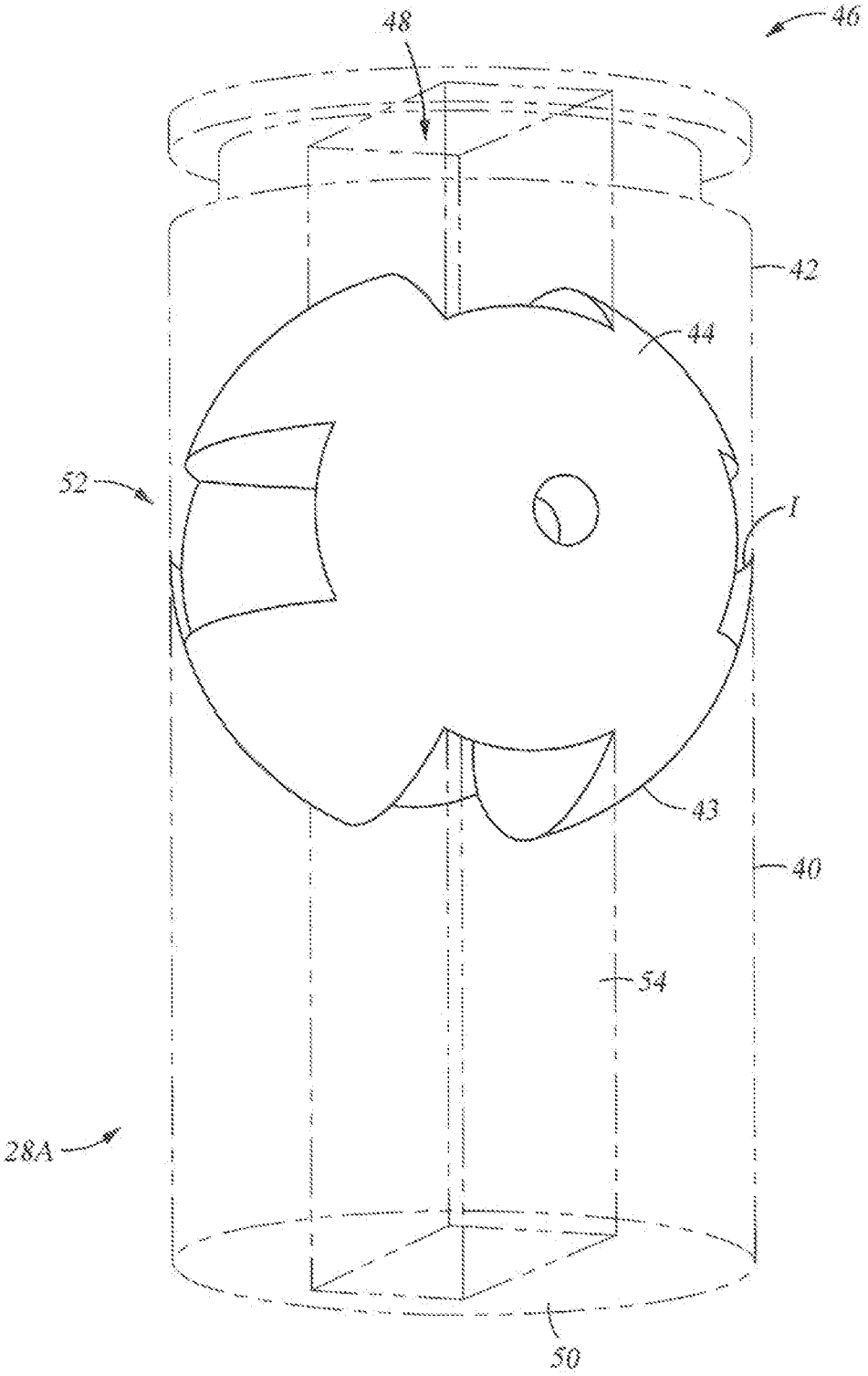
FIG. 2 is a side perspective and partial phantom view of an embodiment of a pulser assembly for use with the mud pulse telemetry system of FIG. 1.

FIG. 2 shows a side perspective and partially phantom view of an example of the pulser assembly 28A. In this example, pulser assembly 28A includes a lower body 40 on which an upper body 42 is supported. The upper and lower bodies 40, 42 of FIG. 2 each have a substantially cylindrically outer surface. Hemispherical shaped recesses are formed in each of the bodies 40, 42 and along an interface I where the bodies 40, 42 are joined. When the bodies 40, 42 are mated as shows, the recesses defined a generally spherically shaped cavity 43. A rotary member 44 is shown disposed in the recess 43, and which is one example of a rotatable member that can be provided in the recess 43. In the illustrated example, rotary member 44 is shown having a generally spherical outer surface. However, rotary member 44 could also have other shapes, such as cylindrical, dislike, or ovoid.

Further in the example of FIG. 2, a cap 46 is inserted into an opening formed on an end of upper body 42 distal from lower body 44. Cap 46 has sections of different diameters, in the example of FIG. 2, the smaller diameter portion is inserted into the opening on the upper body 42. An aperture 48 is formed axially through cap 46, which provides fluid communication between an outer surface of cap 46 and cavity 43. As shown, a lower passage 50 extends axially through the entire length of lower body 40, where a lower end intersects with a lower surface of lower body 40, and where an upper end terminates at cavity 43. Lower passage 40 thereby provides fluid communication between cavity 43 and lower surface of lower body 40. Ports 52, 54 are illustrated extending fully through the rotary member 44 at angularly spaced apart locations. In the embodiment of FIG. 2, port 54 has an end facing aperture 48, and an opposing end facing an end of lower passage 50. Thus in the illustrated orientation, fluid communication is selectively provided between aperture 48 and lower passage 50 through port 54. Moreover, examples exist wherein the fluid communication between aperture 48 and lower passage 50 through ports 52, 54 takes place for discrete periods of time.

Figure 3B:
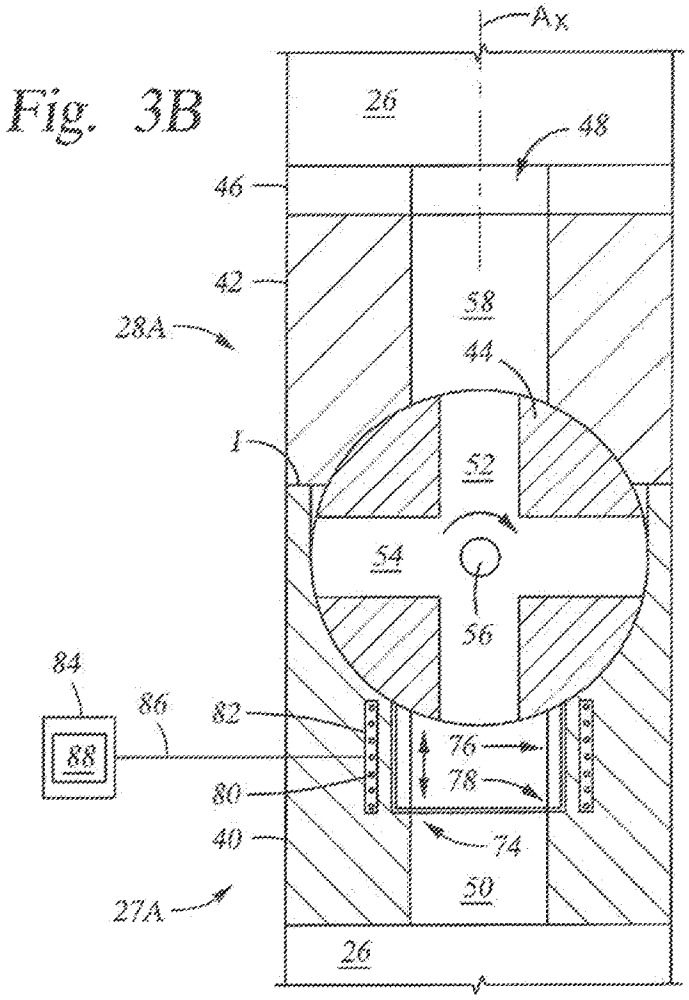
FIGS. 3A and 3B are sectional schematic views of the pulser assembly of FIG. 2.
Figure 3A:
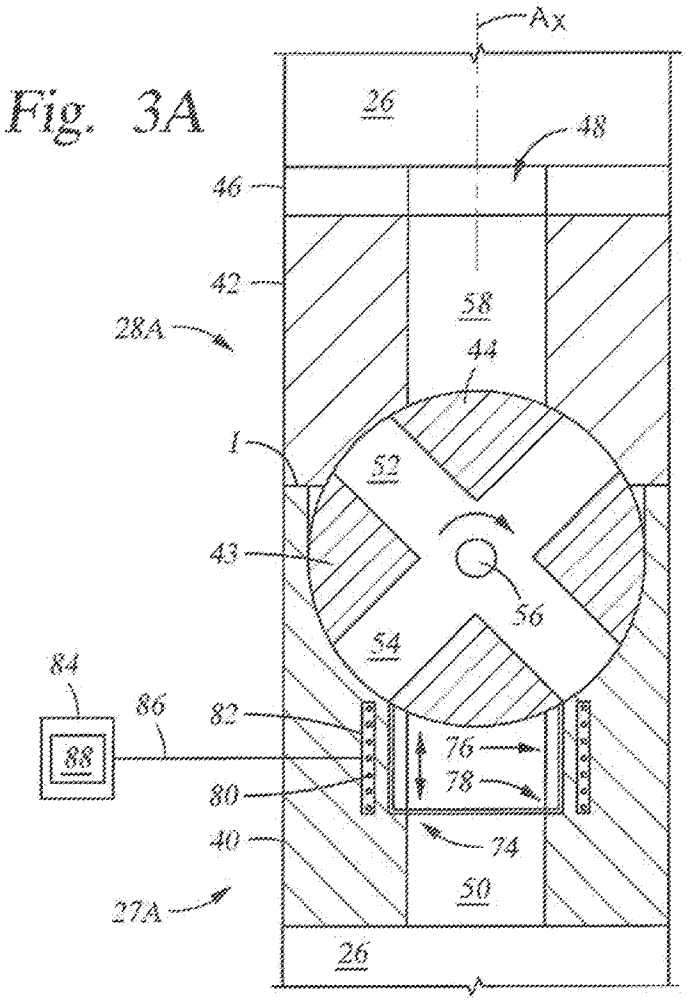

FIGS. 3A and 3B are side sectional schematic views of the mud pulser system 27A axially disposed in the flow path 26. Depicted in FIGS. 3A and 3B are examples of rotating the rotary member 44 to selectively block and/or allow fluid communication through the pulser assembly 28A to create pressure pulses in the fluid flowing through the pulser assembly 28A. A bore 56 is shown formed laterally through the rotary member 44. FIG. 3A illustrates the pulser assembly 28A in a closed orientation wherein all, or substantially all, of the fluid flowing through the flow path 26, from drill string 16 (FIG. 1), is blocked by the closed pulser assembly 28A. In the illustrated example, a passage 58 extends axially through upper body 42, and in a direction generally parallel with an axis $A_X$ of pulser assembly 28A. Fluid flowing through flow path 26 is directed to rotary member 44 via passage 58. FIG. 3B depicts the pulser assembly 28A in an open orientation, i.e. an end of port 52 is registered with passage 58, and an opposite end of port is registered with passage 50; so that fluid in upper passage 58 can make its way to the lower passage 50 through port 52. Alternatively, the rotary member 44 can be oriented so that the opposing ends of port 54 are in selective registration with upper and lower passages 58, 50.

As discussed above, data recorded by the sensor 23 can be pressure encoded into the drilling fluid flowing through the pulser assembly 28A by strategically blocking or allowing flow through the pulser assembly 28A along a designated time sequence. An advantage of the rotary member 44 over other known mud pulsing systems is that each rotation of the rotary member 44 can generate four pulses. This advantages of the disclosed pulser assembly 28A over known mud pulsing include the ability to generate a greater number of pulses over time, to generate pulses that are more discrete, and to generate pulses having a shorter time length. Optionally, the rotary member 44 can be oscillated in order to increase response times. In one example of operation, the pulses generated by the pulser assembly 28A are sinusoidal pulses. In an example, an offset (not shown) is provided between the rotary member 44 and bodies 40, 42 to allow a flow of drilling fluid through the pulser assembly 28A, even when in the closed orientation. In another optional embodiments the pulser assembly 28A is axially moveable within the flow path 26 to clear debris from within that may have become deposited within the pulser assembly 28A.

Figure 4:
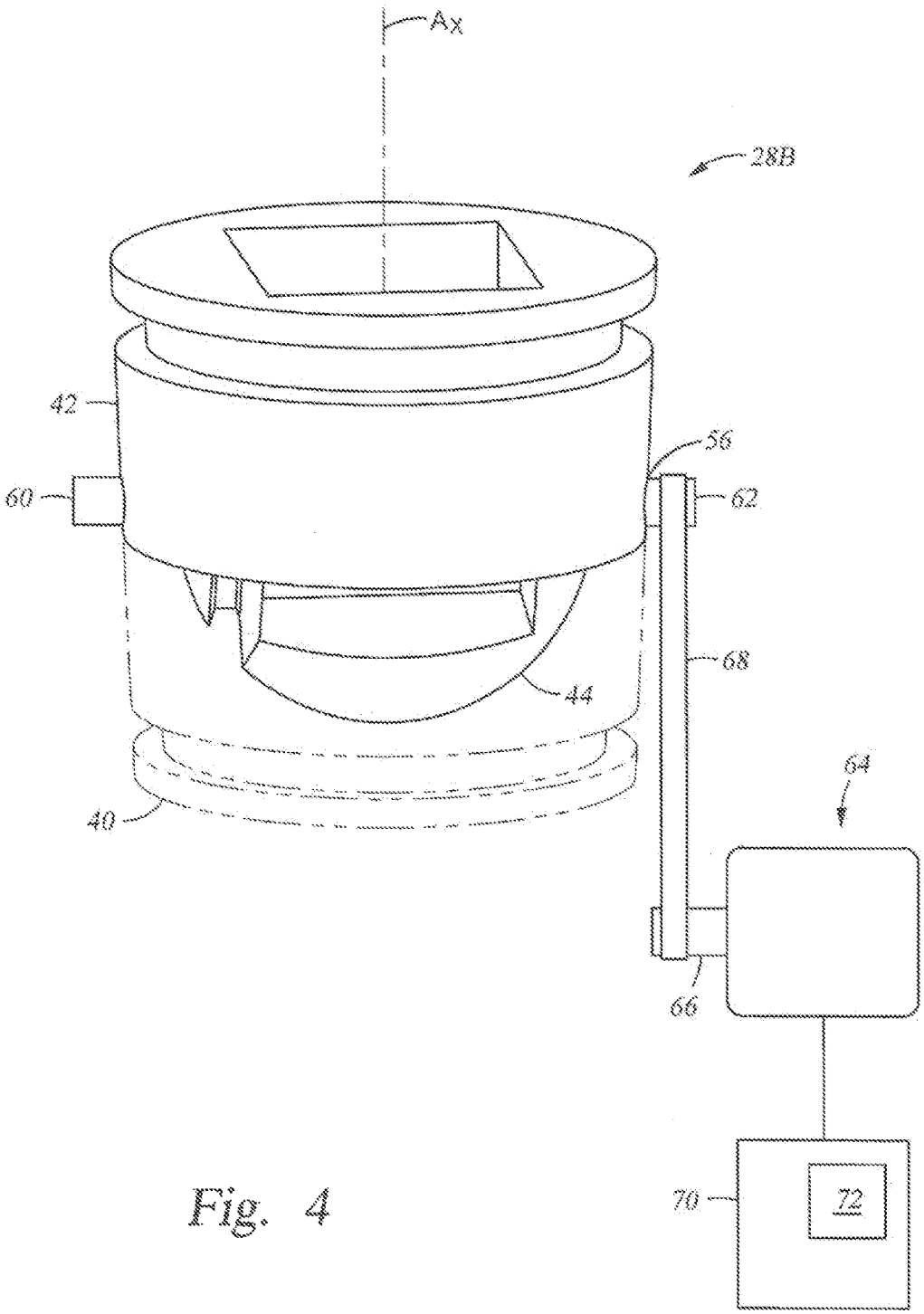
FIG. 4 is a side perspective view of the pulser assembly of FIG. 2 coupled with an example of an actuator.

Referring now to FIG. 4, shown in a side perspective view is an alternate example of the mud pulser system 27A where the pulser assembly 28B is equipped with pins 60, 62 that project radially outward from the bore 56. An actuator 64 is schematically illustrated that has a rotatable shaft 66, and where a belt 68 rotationally couples the pin 62 with the shaft 66. Thus by energizing actuator 64 to rotate shaft 66, pin 62 is rotated through its coupling with belt 68. As pin 62 is mounted in bore 56, rotating pin 62 in turn rotates rotary member 44 within housings 40, 42. A power source 70, which may include a processor 72, is illustrated for powering actuator 64 to selectively rotate rotary member 44. Another example of the actuation of the pulser assembly 28B is the use of gears (not shown) instead of belt 68. A stepper motor or a servo motor (not shown) can drive the actuator 64 through a gear system which is attached to both the actuator 64 and the motor. In one example, processor 72 converts information received front sensor 23 (FIG. 1) to create commands to rotate rotary member 44 at designated times and sequences that in turn generate pressure pulses in the drilling fluid that represent the information from sensor 23 and which is readable by controller 30 (FIG. 1). In another example, the actuator 64 is modulated so that it can perform phase modulation, frequency modulation, and amplitude modulation when generating mud pulses.

Referring back to FIGS. 3A and 3B, optionally included with the mud pulser system 27A is an elevator assembly 74 for selective axial movement of the rotary member 44. Axially moving the rotary member 44 can flush out or otherwise remove any debris (not shown) in the drilling mud that may have deposited or accumulated on or proximate the rotary member 44. The example of elevator assembly 74 shown includes a tubular like plunger 76 coaxially disposed in a recess 78 that is formed along the sidewalls of the lower passage 50 and adjacent rotary member 44. Further depicted in this example of the mud pulser system 27A are windings 80 shown disposed in a cavity 82 formed in the lower body 40, and where the cavity 82 is an annular space that circumscribes recess 78. An optional power source 84 is shown for energizing windings 80, where power source 84 can be disposed downhole with the BHA 20 (FIG. 1), or remote from BHA 20, such, as on surface 29. A line 86 is depicted as an example of a communication means for delivering electricity from power source 84 to windings 80. In one example of operation, windings 80 are energized with electricity from power source 84 thereby moving plunger 76 axially within the recess 78. A spring (not shown), or other resilient element, can be disposed in the recess 78 to bias the plunger 76 in an up or down orientation when the windings 80 are not energized. Optionally, a direction of applied current in the windings 80 can be reversed to move the plunger 76 in a designated position in the recess 78. As shown, the plunger 76 is in supporting contact with the rotary member 44, thus axially moving plunger 76 away from rotary member 44 causes rotary member 44 to move as well, thereby opening spaces between the rotary member 44 and lower and upper bodies 40, 42. Debris accumulated within pulser assembly 28A can escape via the opened spaces. It is within the capabilities of those skilled in the art to determine the time, frequency, and duration to activate the elevator system 74 for debris removal. An optional controller 88 is provided with power source 84 that can be programmed for scheduled activation of the elevator system 74. In an alternative, controller 88 is in communication with controller 30, and from which commands are delivered to controller 88 to direct operation of the elevator assembly 74. Alternate embodiments of cycling the rotary member 44 include creating pressure differentials above/below the rotary member 44 to force the rotary member 44 axially within the pulser assembly 28A, or a simple actuator with a rod (not shown) that exerts a direct force onto the rotary member 44 or pins 60, 62.

The present invention described herein, therefore, is well adapted to carry out the objects and attain the ends and advantages mentioned, as well as others inherent therein. While a presently preferred embodiment of the invention has been given for purposes of disclosure numerous changes exist in the details of procedures for accomplishing the desired results. For example, the rotary member 44 is not limited to the two ports 52, 54 as shown, but can have number of ports projecting through the rotary member 44. Optionally, the ports can be of the same or different sixes (i.e. cross sectional area), and the cross sectional area(s) of the port(s) can vary along the length(s) or the port(s). These and other similar modifications will readily suggest themselves to those skilled in the art, and are intended to be encompassed within the spirit of the present invention disclosed herein and the scope of the appended claims.

What is claimed is:

1. A mud pulser system for use with a drilling system comprising:

a pulser assembly disposed in a path of drilling fluid flowing through a drill string and that comprises a body with an inlet, an exit, and a cavity between the inlet and exit;

a rotary member disposed in the cavity;

multiple ports formed through the rotary member that extend generally transverse to one another, so that when the rotary member is selectively rotated to register an end of one of the ports with the inlet, an opposing end of the one of the ports registers with the exit so that the drilling fluid flows between the inlet and exit and through the one of the ports, and so that when the rotary member is selectively rotated to move all of the ports out of registration with the inlet, a pressure pulse is generated in the drilling fluid; and an elevator assembly that when selectively activated biases the rotary member into a one of a first or a second position within the pulser assembly.

2. The mud pulser system of claim 1, wherein the rotary member is selectively oscillated to move the one of the ports into and out of registration with the inlet.

3. The mud pulser system of claim 1, wherein the rotary member is axially moveable within the cavity.

4. The mud pulser system of claim 1, wherein the rotary member is selectively rotatable for modulation of frequency, phase, or amplitude of the pressure pulse generated in the drilling fluid.

5. The mud pulser system of claim 4, further comprising a controller for controlling rotation of the rotary member.

6. The mud pulser system of claim 1, wherein the inlet has a square, rectangular, circular, or oval shape.

7. The mud pulser system of claim 1, wherein the rotary member is spherical and rotates about an axis transverse to a direction of a path of drilling fluid.

8. The mud pulser system of claim 1, further comprising an actuator coupled to the rotary member.

9. The mud pulser system of claim 1, wherein the ports intersect with one another in a mid-portion of the rotary member.

10. A method of generating mud pulses in a wellbore comprising:

a. providing a mud pulser system having a pulser assembly that comprises a body, an upper passage in the body, a cavity in the body intersected by the upper passage, a lower passage in the body that intersects a portion of the cavity distal from the upper passage, and a rotatable member in the cavity having an outer surface, multiple ports that each have distal ends intersecting the outer surface at substantially diametrically opposed locations, and passages in the body that terminate at the ports and that intersect with one another in the rotatable member;

b. disposing the mud pulser system in a wellbore;

c. providing a supply of drilling fluid to an end of the upper passage distal from the cavity;

d. generating pulses in the drilling fluid by rotating the rotatable member to selectively move the ports into registration with both the upper and lower passages thereby providing fluid communication through the pulser assembly for discrete periods of time; and e. biasing the rotatable member into a one of a first or a second position within the pulser assembly.

11. The method of claim 10, wherein a single rotation of the rotatable member generates four pulses in the drilling fluid.

12. The method of claim 10, further comprising removing debris accumulated within the axially moving rotatable member.

13. The method of claim 10, further comprising modulating one or more of a frequency, phase, or amplitude of the generated pulses.

14. The method of claim 10, wherein the pulses represent data, the method further comprising monitoring the pulses in the drilling fluid to identify the data represented by the pulses.

15. A drilling system comprising:

a drill string having an annulus in communication with a supply of drilling fluid;

a bottom hole assembly mounted to an end of the drill string;

a flow path in the bottom hole assembly in communication with the annulus in the drill string, so that when drilling fluid is directed through the drill string, the drilling fluid flows into the flow path; and a pulser assembly disposed in the flow path, and that comprises a body with an inlet, an exit, and a cavity between the inlet and exit, a rotary member disposed in the cavity and that rotates about an axis that is transverse to the flow path, an elevator that when selectively activated biases the rotary member into a one of a first or second position within the pulser assembly, and multiple ports formed through the rotary member.

16. The drilling system of claim 15, wherein selectively rotating the rotary member registers an end of one of the ports with the inlet and registers an opposing end of the one of the ports with the exit, so that the drilling fluid flows between the inlet and exit and through the one of the ports, and so that when the rotary member is selectively rotated to move all of the ports out of registration with the inlet, a pressure pulse is generated in the drilling fluid.

17. The drilling system of claim 15, wherein rotating the rotary member while drilling fluid is flowing through the pulser assembly generates a pressure pulse in the drilling fluid, and wherein the pressure pulse is monitored.

18. The drilling system of claim 15, further comprising a processor for controlling rotation of the rotary member, so that the rotation of the rotary member is controlled to generate pressure pulses in the drilling fluid, wherein data is encoded in the pressure pulses that can be decoded at a location distal from the rotary member.

* * * * *